US006269622B1

(12) United States Patent
Simon

(10) Patent No.: US 6,269,622 B1
(45) Date of Patent: Aug. 7, 2001

(54) SUPPORT DISK OF A ROTOR SPINNING DEVICE

(75) Inventor: Karsten Simon, Mönchengladbach (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/408,585

(22) Filed: Sep. 29, 1999

(30) Foreign Application Priority Data

Oct. 1, 1998 (DE) ..... 198 45 237

(51) Int. Cl.[7] ..... D01H 4/12
(52) U.S. Cl. ..... 57/406; 57/264; 57/407
(58) Field of Search ..... 57/264, 406, 407

(56) References Cited

U.S. PATENT DOCUMENTS

| | | | | |
|---|---|---|---|---|
| 5,509,262 | * | 4/1996 | Stahlecker | 57/264 |
| 5,675,964 | * | 10/1997 | Stahleker | 57/406 |
| 5,799,478 | * | 9/1998 | Legrom | 57/406 |
| 5,960,623 | * | 10/1999 | Legrom | 57/406 |
| 6,009,700 | * | 1/2000 | Wassenhoven et al. | 57/263 |

FOREIGN PATENT DOCUMENTS

| | | |
|---|---|---|
| 244206 A1 | 12/1985 | (DE) . |
| 41 21 387 A1 | 1/1993 | (DE) . |
| 43 13 753 A1 | 4/1993 | (DE) . |
| 195 31 660 A1 | 8/1995 | (DE) . |
| 298 06 031 U1 | 4/1998 | (DE) . |
| 38 14 921 A1 | 5/1998 | (DE) . |
| WO 96/11407 A1 | 4/1996 | (WO) . |

* cited by examiner

*Primary Examiner*—Andy Falik
(74) *Attorney, Agent, or Firm*—Kennedy Covington Lodbell & Hickman, LLP

(57) ABSTRACT

In rotor spinning devices whose rotors are mounted in a support-disk bearing and in which a support disk (1) has openings (5, 9) serving for the contactless measurement of speed for an optical control of a spinning-start carriage, deposits of dirt, especially fine dust, can build up in said openings (5, 9). This impairs the detection of signals. The portion of the inner surface (19) of the openings (6, 9) of a support disk (1) which is located in the direction of the outer edge of the support disk (1) forms such an angle (α) with a line parallel to the axis of rotation (27) that the buildup of deposits of dirt is prevented.

10 Claims, 2 Drawing Sheets

SUPPORT DISK OF A ROTOR SPINNING DEVICE

BACKGROUND OF THE INVENTION

The present invention relates generally to a support disk for a rotor spinning device and more particularly to a support disk having openings located in the measuring range of a sensor device using a light source to emit a light beam to a receiving device.

In a customarily used design of a rotor spinning device, the spinning rotor is mounted by its rotor shaft in the nip of two pairs of support disks and is driven by a tangential belt which acts on the rotor shaft from above. One of the pair of support disks which are located most outwardly relative to the rotor, comprises means on the outer side facing a light source which serves to intermittently reflect the incident light or intermittently interrupt the reflection of the light. Part of the reflected light of the light source strikes a measuring device and is converted into signals for measurement of the rotor speed. If, for example, a yarn break occurs at the spinning location, it is detected via a monitoring of the yarn and the rotor of this spinning location is stopped. The stopping of the support disks associated with the rotor is then recognized by the absence of signals for the speed measurement. A signal requesting a spinning-start carriage follows in order to correct the yarn break and to start spinning the yarn again. The broken yarn ends are automatically rejoined by a splicing or piecing operation during the startup time of the rotor at a certain speed which is significantly lower than the spinning speed of the rotor. When the rotor has attained the particular speed favorable for the splicing/piecing operation, the spinning-start carriage performs the automatic joining of the yarn ends. After the reconnection of the yarn ends has taken place, the rotor does not attain its spinning speed until after a further startup time since the tangential belt must still accelerate the rotor and the support disks up to this spinning speed. The speed monitoring and speed control are of considerable significance for attaining and maintaining of the required yarn parameters.

Such rotor spinning devices are described, for example, in German Patent Publications DE 41 21 387 A1 and DE 195 31 660 A1. German Patent Publication DE 195 31 660 A1 teaches that, for an operationally reliable and rapid detection of the speed and of changes in the speed during an acceleration phase or braking phase of the rotor of rotor spinning machines, the receiving system of a reflection light barrier is adjusted to reflex light from an illuminating light beam and to scatter the reflex light on a main surface of the rotating body of a support disk having at least one bore on the line of the light beam, the bore being slightly reflective for the entire light beam relative to the main surface of the support disk body and acts like a light trap. In particular, the action of the bore as a light trap or light sink is important to essentially eliminate light scattering in order to achieve a sufficient contrast for error-free speed measurement even in the case of a main disk body surface which reflects light only weakly.

During the operation of the rotor spinning device, deposits of dirt and fibers settle in the bore of the support disk. The bore gradually grows from the outside toward the inside in the direction of the axis of rotation as a result of such deposits of dirt and yarns, which can prevent a distinct contrast to be registered by the receiving system between the light scattered by the main surface of the rotating support disk body and the non-reflected light entering the particular bore.

Furthermore, reflection light scanners are known from German Patent Publication DE 195 31 660 A1 in which light emitters and light receivers are supported in a housing as in a reflection light barrier. The presence of the light spot, e.g., of a laser light spot, is detected in an image plane with such light scanners. The surface of the support disk acts as an image plane. When the light spot dips into an opening its image is distinctly behind it and is no longer recognized. There is still the danger of a contamination on the support disks, primarily by fluff formation, which hinders the operational reliability of the speed measuring operation. Dirt settles especially in through openings of the support disks, as is schematically shown in FIG. 5 of this patent.

German Patent Publication DE 41 21 387 A1 teaches lateral disks set on the lateral surfaces of the support disks which lateral disks cover the bores in the support disk and therewith prevent such deposits of dust and yarns. These superimposed lateral disks represent additional required structural components which have to be mounted and render a distinct contrast between the scattered light reflected from the surface of the support disk and between the light entering the particular bore more difficult due to their reflection behavior, thereby preventing a reliable recognition of signals.

German Patent Publication DE 43 13 753 A1 teaches a support disk for a support-disk bearing of open-end spinning rotors in which a front side is provided with signal generators for a contactless speed measuring which operate by means of magnetic field lines. Permanent-magnet pins are fit into the support disk which generate an induction current. In another embodiment of the support disk of aluminum or plastic, the signal generator is constructed of ferromagnetic material.

In a further version of this known support disk the main casting of the support disk consists of steel and the signal generator is a bore let into the main casting. An electric signal can also be collected in this manner. The induction current produced is supplied via an electric line to an evaluation device which is connected to various control motors of the spinning-start device. This inductive method is intended to prevent imprecise signals from being supplied when the support-disk pairs are clogged with fluff. The pulse sensors must be positioned relatively close to the surface of the main casting of the support disks in order to assure sufficient precision and strength of the signals. The creation of disturbing air vortices given the necessary position of the pulse sensors near the surface is a disadvantage. Given the high speed of the support disk, even two bores in the front side of a support disk bring about air blasts of such a strength that the bores can also be used as signal generators in association with pulse sensors positioned near the surface for a speed measurement in which the particular air blast is registered and evaluated as a signal, as explained in German Patent Publication DE 43 13 753 A1 in column 2, lines 34 to 38.

SUMMARY OF THE INVENTION

The present invention therefore has a basic objective of further improving a support disk in such a manner that the aforementioned disadvantages of known support disks are reduced or avoided and the detection of the signals for speed measurement is improved.

This objective is solved in accordance with the present invention by providing a rotor spinning device with a support disk comprising openings disposed in the measuring range of the light beam of a speed sensor device wherein each of the openings is formed with an inner surface at least a portion of which is located in the direction of an outer edge of the support disk and forms an angle with a line parallel to the axis of rotation of the support disk, thereby for preventing accumulation of debris during the operation of the rotor spinning device.

The angular position of the inner surface of the openings of the support disk in accordance with the invention offers no hold for deposits of dirt during the rotation of the support disk and also acts in a self-cleaning manner. A gradual closing of the openings due to deposits of dust and yarns is effectively prevented and the ongoing recognition of the light signals is not hindered by such deposits.

It is especially advantageous if the portion of the inner surface of the openings which is located in the direction of the outer edge of the support disk forms a knife edge having a tip facing in the direction of the axis of rotation of the support disk. In particular, the design of the openings with a knife edge allows no room for deposits of dirt.

A knife edge which is beveled preferably toward both sides of the support disk makes possible an arrangement of the inner surface, designed as an oblique lateral surface of the knife edge, at an even sharper angle and reinforces therewith the action which prevents and even degrades deposits. The knife edge can be produced preferably via a milling or grinding operation which can take place in conjunction with the formation of the opening into the support disk.

The openings are advantageously designed as slots and arranged in a radially extending orientation. In this manner, a greater number of openings, which is desirable for a precise measurement of the speed, can be placed into the support disk on a graduated circle without inadmissibly weakening the structure of the support disk. The increased number of measuring pulses thereby achieved per revolution of the support disk raises the precision of the speed measurement considerably.

In a preferred embodiment the support disk has a surface which reflects the light beam, especially a laser light beam, as diffuse scattered light, and the light receiver is designed as a reflection light barrier. A laser light beam supplies a sufficient light strength for the light signal, even in the case of a small cross section of the light beam, as is desired for small opening cross sections. The support disk preferably is formed of aluminum and is manufactured as an extrusion molding part. After the extrusion molding process, the surface of the main casting of the support disk already has a sufficient light reflective behavior and requires no reworking of the surface.

In a further advantageous embodiment of the support disk, the openings are produced using a non-complicated, cost-saving manufacturing process such as, e.g., punching and the required angle $\alpha$ of the inner surface is formed by a subsequently placed structural component advantageously produced from plastic.

The design of the support disk in accordance with the invention can be manufactured in a simple and economical manner and effectively prevents the buildup of dirt deposits and an impairment of the process of speed measurement arising from said buildup.

Further details, features and advantages of the present invention are explained in and will be understood from the following disclosure with reference to exemplary embodiments shown in the accompanying drawings.

DETAILED DESCRIPTION OF THE PREFERRED EMBODIMENTS

Figure 2:
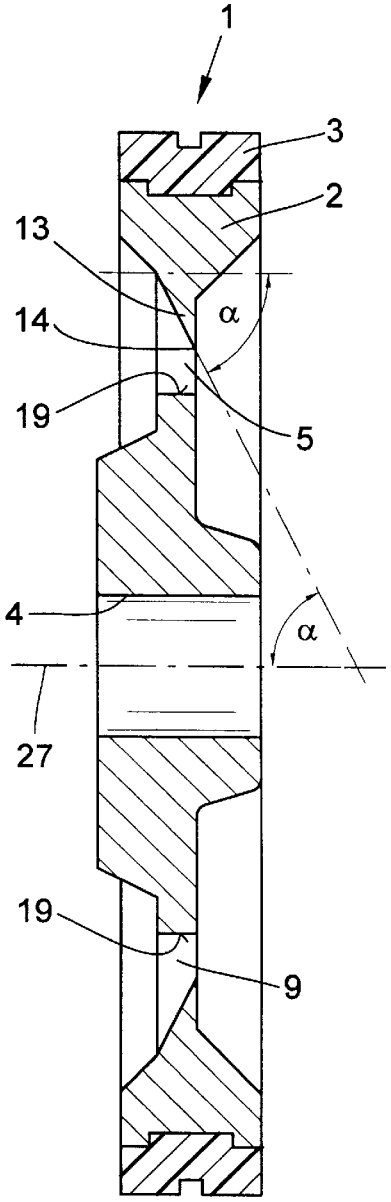
FIG. 2 shows the support disk of FIG. 1 in axial cross section.
Figure 1:
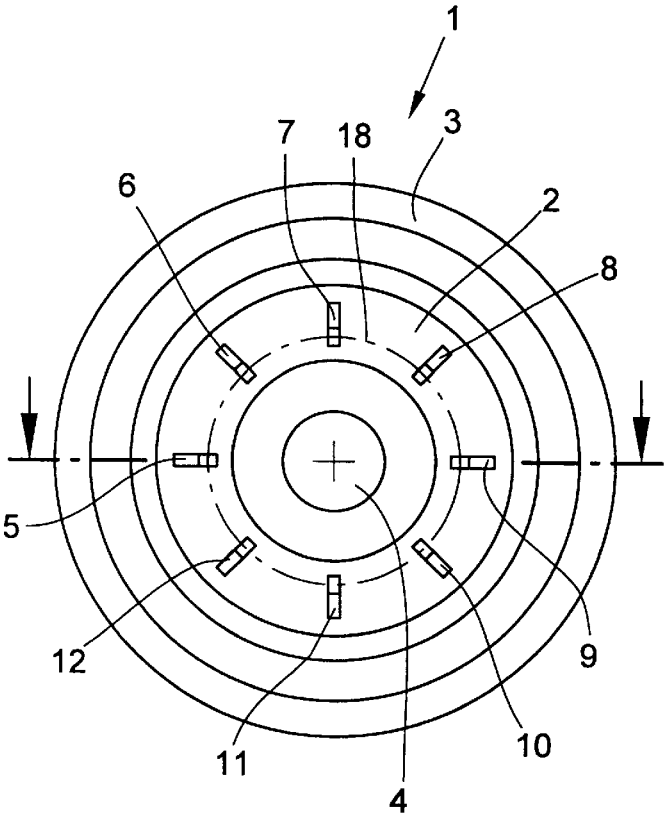
FIG. 1 shows an elevation of a support disk for a rotor spinning device in accordance with one preferred embodiment of the present invention.

Referring now to the accompanying drawings and initially to FIGS. 1 and 2, main casting 2 of support disk 1 comprises central bore 4 for receiving a shaft (not shown) of support disk 1 and carries continuous lining 3 on its periphery, which lining serves in a known manner as support for a rotor shaft (also not shown). Running lining 3 is, e.g., a solid-rubber tire of wear-resistant rubber fitted onto the circumferential surface of support disk 1.

Main casting 2 furthermore comprises eight slot-like openings 5 to 12 arranged in a rotationally symmetric manner on graduated circle 18. Openings 5 to 12 run radially and are arranged in a stellate pattern at the same interval from each other on graduated circle 18. With this arrangement, the stability of main casting 2 remains preserved and the signals for the light transmitting/receiving system are sent in short succession for a precise measurement of speed.

The number of openings 5 to 12 and therewith the number of signals per revolution can be increased for an increased precision of the measurement of speed, which is particularly advantageous during the acceleration procedure of support disk 1.

The inner surface of opening 5 located toward the outer edge of support disk 1 forms knife edge 13, whose tip 14 faces in the direction of axis of rotation 27, as shown in the sectional view of support disk 1 in FIG. 2. The portion of inner surface 19 of opening 5 which is located in the direction of axis of rotation 27 of main casting 2 runs parallel to axis of rotation 27. On the other hand, the lateral surface of knife edge 13 run vertically on the one side and on the other side at such an angle $\alpha$ to a line parallel to axis of rotation 27 that no deposits of dust or yarn remnants can settle on the entire inner surface 19 of opening 5 during the operation of support disk 1.

Figure 3:
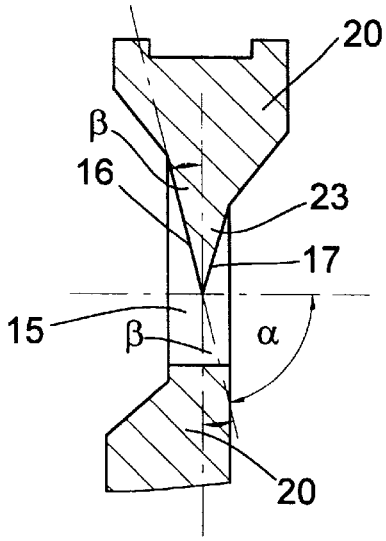
FIG. 3 shows a sectional view through an opening in another embodiment of the support disk.

The partial view of main casting 20 with opening 15 in FIG. 3 shows a design of knife edge 23 in which both lateral surfaces 16, 17 form an acute angle $\beta$ with a radial line to axis of rotation 27. Angles $\alpha$ and $\beta$ combine to equal 90°. In the embodiment shown, lateral surfaces 16, 17 are arranged steeper under an angle $\beta$ of approximately 25° than the oblique lateral surface of knife edge 13 in FIG. 2. As a result thereof, the depositing of dirt is counteracted to an even greater extent and the self-cleaning action is reinforced even more.

Figure 4:
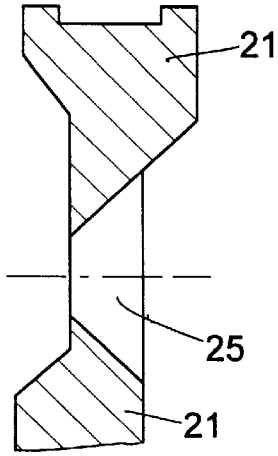
FIG. 4 shows a sectional view through an opening of a further embodiment of the support disk.

Opening 25 in FIG. 4 can be advantageously manufactured by boring or milling of main casting 21 in a single work step. For example, a rotationally symmetric form of opening 25 can be produced in one manufacturing procedure by boring, during which the inner surface of opening 25 likewise assumes such an angular position that the deposition of dirt is prevented.

Figure 5:
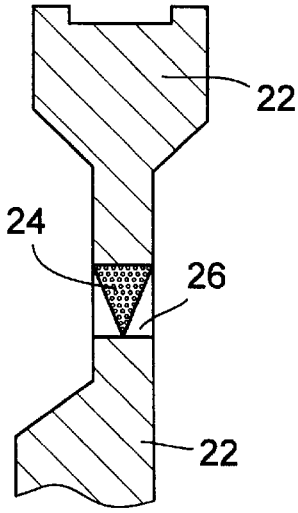
FIG. 5 shows an opening of a support disk with a deposit of dirt in section.

The partial view of a main casting 22 with opening 26 shown in section in FIG. 5 illustrates the state of the art. The design of opening 26, which can be manufactured by punching, favors the buildup of dirt deposit 24, which hinders a reliable transmission and recognition of light signals. Support disk 1 in accordance with the present invention prevents such a buildup of dirt and fibrous fluff and prevents the impairment of the process of speed measurement resulting therefrom.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In a rotor spinning device having a sensor device with a light source which emits a light beam and with a receiving device for receiving the light beam, a support disk (1) comprising openings (5 to 12, 15, 25, 26) disposed in a measuring range of the light beam of the sensor device, each of the openings (5 to 12, 15, 25, 26) having an inner surface (19) at least a portion of which is located in the direction of an outer edge of the support disk (1) and forms an angel ($\alpha$) with a line parallel to the axis of rotation (27) of the support disk (1) for preventing accumulation of debris during the operation of the rotor spinning device.

2. The support disk according to claim 1, characterized in that angle ($\alpha$) is more than 50°.

3. The support disk according to claim 1, characterized in that angle ($\alpha$) is between about 60° and about 85°.

4. The support disk according to claim 1, characterized in that an inner surface (19) of the openings (5 to 12, 15, 25, 26) of the support disk is configured in a funnel shape at least partially extending interiorly from a main surface (2) of the support disk (1).

5. The support disk according to claim 1, characterized in that the portion of the inner surface (19) of the openings (5 to 12, 15, 25, 26) located in the direction of the outer edge of the support disk (1) forms a knife edge (13, 23) having a tip (14) facing in the direction of the axis of rotation (27) of the support disk (1).

6. The support disk according to claim 5, characterized in that the knife edge (23) is beveled toward opposite sides of the support disk (1).

7. The support disk according to claim 1, characterized in that the openings (5 to 12, 15, 25, 26) comprise slots extending radially relative to the support disk (1).

8. The support disk according to claim 1, characterized in that the support disk (1) has a surface for reflecting the light beam as diffuse scattered light and in that the receiving device is a reflection light barrier.

9. The support disk according to claim 1, characterized in that the support disk (1) comprises an extrusion molding part of aluminum.

10. The support disk according to claim 1, characterized in that support disk (1) comprises a structural part disposed at an angle $\alpha$ to the inner surface (19) of the openings (5 to 12, 15, 25, 26).

* * * * *